US007302214B2

(12) United States Patent
Imura

(10) Patent No.: US 7,302,214 B2
(45) Date of Patent: Nov. 27, 2007

(54) DEVELOPING DEVICE HAVING A VOLTAGE APPLICATION MEMBER FOR APPLYING VARIED VOLTAGES

(75) Inventor: Tomoyuki Imura, Toyohashi (JP)

(73) Assignee: Konica Minolta Business Technologies, Inc., Tokyo (JP)

( * ) Notice: Subject to any disclaimer, the term of this patent is extended or adjusted under 35 U.S.C. 154(b) by 0 days.

(21) Appl. No.: 11/019,477

(22) Filed: Dec. 23, 2004

(65) Prior Publication Data

US 2006/0078357 A1 Apr. 13, 2006

(30) Foreign Application Priority Data

Oct. 13, 2004 (JP) ..... 2004-298410

(51) Int. Cl.
*G03G 15/08* (2006.01)

(52) U.S. Cl. ..... 399/284

(58) Field of Classification Search ..... 399/279, 399/274, 284
See application file for complete search history.

(56) References Cited

U.S. PATENT DOCUMENTS 4,378,158 A * 3/1983 Kanbe ..... 399/281
2001/0048828 A1* 12/2001 Ishii et al. ..... 399/281

FOREIGN PATENT DOCUMENTS

JP 59116770 A * 7/1984
JP 63-46481 2/1988
JP 5-11583 1/1993
JP 5-53428 3/1993
JP 05173413 A * 7/1993
JP 6-149032 5/1994
JP 06149032 A 5/1994
JP 08202127 A * 8/1996
JP 10-31358 2/1998
JP 10-133474 5/1998
JP 63-155065 6/1998
JP 11-272069 10/1999
JP 2000-19840 1/2000
JP 2000-321868 11/2000
JP 2001075357 A 3/2001
JP 2002-207355 7/2002

OTHER PUBLICATIONS

Japanese Office Action dated Feb. 20, 200 7, directed at counterpart JP application No. 2004-298410.

* cited by examiner

*Primary Examiner*—Quana Grainger
(74) *Attorney, Agent, or Firm*—Morrison & Foerster LLP

(57) ABSTRACT

A developing device 10 has a voltage application member 18 which is in contact via a toner layer with a developing roller 14 that rotates while holding the toner layer on its outer peripheral surface. To the toner layer, the voltage application member 18 applies a relatively low voltage in an upstream-side contact portion with respect to a rotational direction of the developing roller 14, and applies a relatively high voltage in a downstream-side contact portion thereof.

14 Claims, 5 Drawing Sheets

DEVELOPING DEVICE HAVING A VOLTAGE APPLICATION MEMBER FOR APPLYING VARIED VOLTAGES

RELATED APPLICATION

This application is based on Japanese Patent Application No. 2004-298410, the content of which incorporated herein by reference.

BACKGROUND OF THE INVENTION

The present invention relates to a developing device to be used for electrophotographic image formation apparatuses such as printers and copiers.

In electrophotographic image formation apparatuses such as printers and copiers, there has conventionally been used a developing device which develops with toner an electrostatic latent image formed on a surface of a photoconductor to visualize the image. This developing device generally has a developing roller or developing sleeve which rotates while holding charged toner on the outer peripheral surface in a thin layer state, so that toner is fed onto the photoconductor from the developing roller or the like.

Meanwhile, as printers have been wide-spreading in offices rapidly in recent years, users have been becoming increasingly more conscious of image quality and cost. One of image noise is 'fogging' which occurs due to deposition of the toner at portions other than the latent image on the photoconductor. This occurs more often due to a deterioration of toner charge amount resulting from a deterioration of the toner within the developing device during endurance time. The deterioration of toner charge amount due to endurance causes not only image deteriorations but also increases in toner consumption, which substantially causes larger burdens of cost on users.

For electric charging of the toner in the developing device, as is a general method, a blade-like member is brought into press contact against the developing roller, and the toner held on the developing roller in a thin layer state is frictionally rubbed by the blade-like member, thereby electrically charged. However, a nip width formed between the blade-like member and the developing roller, if small, would make it hard to impart a sufficient charge amount to deteriorated toner. Thus, For obtainment of larger nip widths, there have been proposed methods for bringing a film-like member into press contact with the developing roller in Japanese Patent Laid-Open Publications Nos. S63-155065, H05-11583, H10-31358, H10-133474 and H11-272069.

However, in the case where the nip width is broadened by using a film-like member, there is a tendency that although the toner charge amount gradually increases while passing through within the nip, yet the toner becomes less charged in downstream-side part within the nip with respect to the rotational direction of the developing roller, so that the charge amount reaches the ceiling and a desired charge amount cannot be obtained. This tendency is considerable particularly with deteriorated toner, causing a problem that the fogging involved in endurance cannot be improved.

SUMMARY OF THE INVENTION

Accordingly, an object of the present invention is to provide a developing device which is capable of imparting a sufficient charge amount even to deteriorated toner so that occurrence of the fogging can be reduced.

In order to achieve the above object, in a first aspect of the present invention, there is provided a developing device comprising a voltage application member which is in contact via a toner layer with a developing roller that rotates while holding the toner layer on its outer peripheral surface, wherein to the toner layer, the voltage application member applies a relatively low voltage in an upstream-side contact portion with respect to a rotational direction of the developing roller, and applies a relatively high voltage in a downstream-side contact portion thereof.

With the developing device of this constitution, toner can be charged to an appropriate level by applying such a relatively low voltage that no leakage occurs in the upstream-side contact portion, and a desired toner charge amount can be obtained by applying such a relatively high voltage that the toner does not reach the ceiling but can be sufficiently charged in the downstream-side contact portion. Thus, a desired charge amount can be obtained even with deteriorated toner, and the occurrence of fogging can be improved.

In the developing device of the first aspect of the invention, the voltage application member may comprise one member which makes contact over a specified angle range with respect to the rotational direction of the developing roller, and resistivity of the upstream-side contact portion is larger than resistivity of the downstream-side contact portion.

Also in the developing device of the first aspect of the invention, the voltage application member may be so formed as to be thicker in the upstream-side contact portion and thinner in the downstream-side contact portion. In this case, thickness of the contact portion of the voltage application member may be either varied in a step-by-step manner or continuously varied.

Also in the developing device of the first aspect of the invention, the upstream-side contact portion and the downstream-side contact portion of the voltage application member may be either formed of an identical material or different in material from each other.

Also in the developing device of the first aspect of the invention, it is possible that the voltage application member, by being pressed toward the developing roller by an electrically conductive backup member, is brought into contact with the developing roller over a specified angle range with respect to the rotational direction, and the voltage application member comprises one member to which a voltage is applied via the backup member, and wherein an upstream-side portion of the backup member with respect to the rotational direction of the developing roller is larger in resistivity than a downstream-side portion thereof.

Also in the developing device of the first aspect of the invention, the voltage application member may comprise one member which makes contact with the developing roller over a specified angle range with respect to the rotational direction of the developing roller, and a voltage is applied to the voltage application member from the downstream-side contact portion side.

Further, in the developing device of the first aspect of the invention, the voltage application member may be divided into the upstream-side contact portion and the downstream-side contact portion. In this case, it is possible that resistivity of the upstream-side contact portion is larger than resistivity of the downstream-side contact portion, and identical voltages are applied to the upstream-side contact portion and the downstream-side contact portion, respectively, or that the upstream-side contact portion and the downstream-side contact portion are of an identical resistivity, and a voltage applied to the downstream-side contact portion is higher than a voltage applied to the upstream-side contact portion.

In a second embodiment of the present invention, there is provided a developing device comprising:

a developing roller which, while holding a toner layer on an outer peripheral surface thereof, is placed opposite to a photoconductor on a surface of which a latent image is to be formed;

a holding member having an opposing face opposed to the outer peripheral surface of the developing roller;

a power supply for applying a voltage to the holding member; and a voltage application member which is fixed to the opposing face of the holding member so as to be in surface contact with the outer peripheral surface of the developing roller, and an upstream-side contact portion of the voltage application member with respect to the rotational direction of the developing roller is higher in resistivity than a downstream-side contact portion thereof.

In the developing device of the second aspect of the invention, thickness of the voltage application member may be larger in the upstream-side contact portion than in the downstream-side contact portion. In this case, thickness of the contact portion of the voltage application member with the developing roller may be either varied in a step-by-step manner or continuously varied.

Also in the developing device of the second aspect of the invention, the upstream-side contact portion and the downstream-side contact portion of the voltage application member may be either formed of an identical material or different in material from each other.

In a third aspect of the present invention, there is provided a developing device comprising:

a developing roller which, while holding a toner layer on an outer peripheral surface thereof, is placed opposite to a photoconductor on a surface of which a latent image is to be formed;

a holding member having an opposing face opposed to the outer peripheral surface of the developing roller;

a power supply for applying a voltage to the holding member; and a voltage application member which has a specified length with respect to a rotational direction of the developing roller and whose downstream-side end portion area is fixed to the opposing face of the holding member so as to be in non-contact with the developing roller and whose upstream-side end portion area is in surface contact with the outer peripheral surface of the developing roller.

In the developing device of the third aspect of the invention, the voltage application member may be formed of a film.

With the use of the developing device of the present invention, a sufficient charge amount can be imparted even to deteriorated toner, and the occurrence of fogging can be improved.

BRIEF DESCRIPTION OF THE DRAWINGS

The present invention will be further described with reference to the accompanying drawings wherein like reference numerals refer to like parts in the several views, and wherein.

DETAILED DESCRIPTION OF THE PREFERRED EMBODIMENTS

Figure 1:
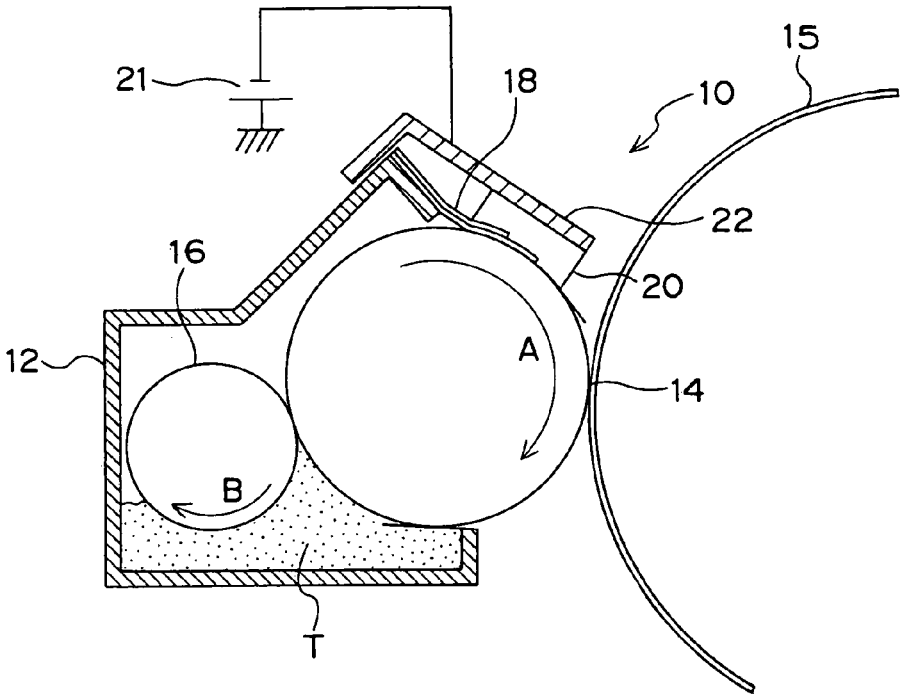
FIG. 1 is a schematic structural view of a developing device.

FIG. 1 is a schematic structural view of a developing device 10 which is an embodiment of the invention. The developing device 10 includes a casing 12 formed of a housing body in which toner T is housed. An opening extending along the longitudinal direction (depth-wise direction of FIG. 1) is formed in the casing 12, and a developing roller 14 is provided at the opening so as to be drivable into rotation along a direction of arrow A. In the developing device 10, the developing roller 14 is placed in opposition and proximity to a drum-like photoconductor 15.

In the casing 12, a feed roller 16 is disposed in contact with the developing roller 14. As the feed roller 16 is driven into rotation along a direction of arrow B, the toner T is fed to the developing roller 14 so that the a thin toner layer is formed on the outer peripheral surface of the developing roller 14.

on top of the casing 12 is fixed a voltage application member 18 formed of, for example, an electrically semi-conductive flexible resin film. The voltage application member 18, which is formed of one member, is pressed against the developing roller 14 by a backup member (holding member) 20 which is attached to an electrode 22 and formed of, for example, an electrically conductive sponge. As a result, the voltage application member 18 is in contact with the developing roller 14 over a specified angle range via the toner layer held on the outer peripheral surface. To the voltage application member 18, a voltage is to be applied via the backup member 20 from the electrode 22 connected to a power supply 21.

It is noted that the voltage application part 18 may be fixed to an opposing face of the backup member 20 confronting the outer peripheral surface of the developing roller by, for example, adhesion or the like, or otherwise may be only held by being pressed by the opposing face without being fixed. The voltage to be applied to the voltage application member 18 is not limited to a DC voltage and may also be a voltage in which an AC voltage is superimposed on a DC voltage.

Figure 2:
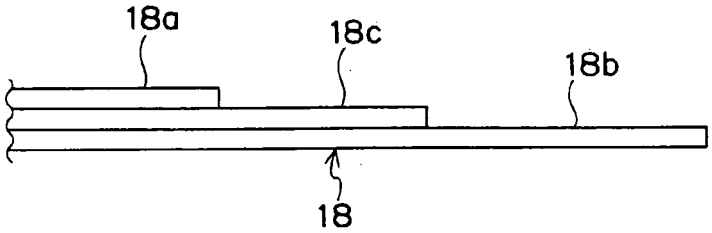
FIG. 2 is a side view of a contact portion of a voltage application member.

A contact portion of the voltage application member 18 with the developing roller 14, as shown in FIG. 2, is so structured that with respect to the rotational direction of the developing roller 14, an upstream-side contact portion **18*a* is composed of three films stacked and bonded together with an electrically conductive adhesive, a downstream-side contact portion 18*b* is composed of one film, and an intermediate contact portion 18***c* therebetween is composed of two films stacked and bonded together with an electrically conductive adhesive. In this way, the contact portion of the voltage application member 18 with the developing roller 14 has its thickness varying in a step-by-step manner from upstream side toward downstream side with respect to the rotational direction of the developing roller 14 so that the upstream-side contact portion 18*a* is thicker and the downstream-side contact portion 18*b* is thinner. As a result, the resistivity value of the voltage application member 18 in the thicknesswise direction is the largest at the upstream-side contact portion 18*a*, mid-level at the intermediate contact portion 18*c* and the smallest at the downstream-side contact portion 18*b*.

It is noted that although the voltage application member 18 of this embodiment is varied in thickness in three steps, yet the thickness variation at the contact portions with the developing roller 14 may be in two steps or four or more steps.

Figure 3:
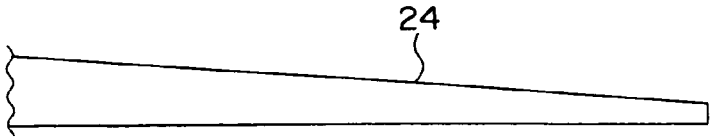
FIG. 3 is a side view of a contact portion of another voltage application member.

Also, although the voltage application member 18 is varied in thickness in a step-by step manner by bonding the three films with their forward end positions shifted from one another, yet it is also possible that one film is molded so as to vary in thickness in a step-by-step manner, or that one film is molded so as to be continuously varied in thickness like a film 24 shown in FIG. 3.

Figure 4:
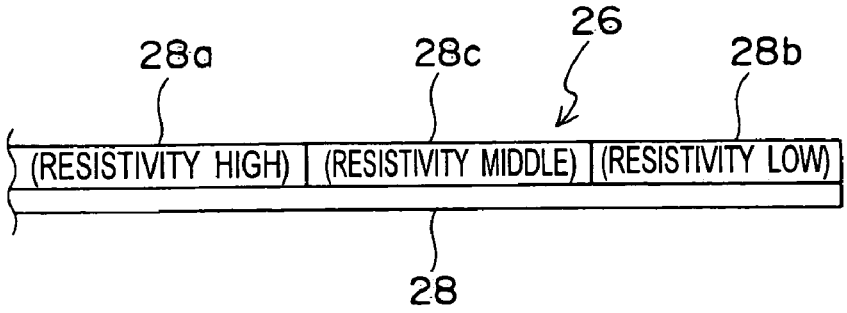
FIG. 4 is a side view of a contact portion of yet another voltage application member.

Further, the voltage application member 18 has its upstream-side contact portion 18*a*, intermediate contact portion 18*c* and downstream-side contact portion 18*b* composed of one identical material. However, it is also possible, like a voltage application member 26 shown in FIG. 4, three types of electrically conductive coating layers 28*a*, 28*b*, 28*c*, having respectively different resistivity values are provided on one film 28 so that the upstream-side contact portion, the intermediate contact portion and the downstream-side contact portion are different in material from one another.

Figure 5:
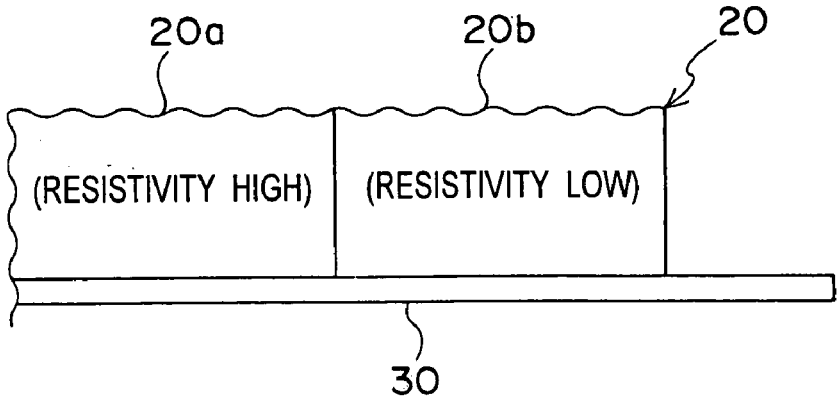
FIG. 5 is a side view of an example in which backup members are different in resistivity value from each other.

Furthermore, the voltage application member 18 is varied in resistivity value between the upstream-side contact portion 18*a* and downstream-side contact portion 18*b* by its own thickness being varied. However, it is also possible that, as shown in FIG. 5, a voltage application member 30 is composed of one film of uniform thickness (i.e., uniform resistivity) while the backup member 20 is set larger in resistivity value at an upstream-side portion 20*a* than at the downstream-side portion 20*b*.

Next, operations of the developing device 10 having the above constitution are described.

In the developing device 10, as the developing roller 14 is driven into rotation along the direction of arrow A, the feed roller 16 is rotationally driven along the direction of arrow B. The toner T housed in the casing 12 is fed to the developing roller 14 by the rotating feed roller 16, by which a thin toner layer is formed on the outer peripheral surface of the developing roller 14.

The toner layer on the outer peripheral surface of the developing roller 14 is moved to a contact area with the voltage application member 18 as the developing roller 14 rotates. During the passage through this contact area, the toner is electrically charged to a desired charge amount. The electric charging is carried out as follows.

To the voltage application member 18, a specified voltage (e.g., −300 V) is applied from the electrode 22 via the backup member 20. However, the resistivity value of the contact portion of the voltage application member 18 with the developing roller 14 is larger at the upstream-side contact portion 18*a*, mid-level at the intermediate contact portion 18*c* and smaller at the downstream-side contact portion 18*b*. Therefore, the effective voltage to be applied to the toner layer on the developing roller 14 is relatively lower at the upstream-side contact portion 18*a*, mid-level at the intermediate contact portion 18*c* and relatively higher at the downstream-side contact portion 18*b*.

While the toner on the developing roller 14 passes through in contact with the upstream-side contact portion 18*a* of the voltage application member 18, the toner is moderately charged with such a relatively low voltage that no leakage occurs between the voltage application member 18 and the developing roller 14. Subsequently, while the toner on the developing roller 14 passes through in contact with the intermediate contact portion 18*c* of the voltage application member 18, the toner is further charged with application of a voltage higher than at the upstream-side contact portion 18*a*, so that the charge amount is increased. Then, while the toner on the developing roller 14 passes through in contact with the downstream-side contact portion 18*b* of the voltage application member 18, the toner is sufficiently charged with application of a voltage even higher than at the intermediate contact portion 18*c*, so that the toner does not reach the ceiling but comes to have a desired charge amount.

It is noted that although relatively higher voltages are applied at the intermediate contact portion 18*c* and the downstream-side contact portion 18*b* than at the upstream-side contact portion 18*a*, yet there occurs no leakage because the toner charge amount gradually increases along with the passage through the contact area with the voltage application member 18 so that the electric potential heightens.

The toner, which has passed through the contact area with the voltage application member 18 and has thereby been charged up to a desired charge amount, is moved to an opposite area to the photoconductor 15 along with the rotation of the developing roller 14 and provided for development of the latent image on the surface of the photoconductor 15.

As described above, according to the developing device 10 of this embodiment, toner can be sufficiently charged up to a desired charge amount. Therefore, a desired charge amount can be imparted even to toner that has deteriorated due to endurance, so that the occurrence of fogging can be improved.

Next, an experiment which was performed to verify the working effects of the developing device 10 of this embodiment is described.

In a Working Example of the developing device 10, a low-resistivity film having a volume resistivity of $2.5\times10^3$ Ω·cm with its thickness continuously varying from 200 μm in the upstream-side contact portion to 50 μm in the downstream-side contact portion as shown in FIG. 3 was used as the voltage application member, and a DC voltage of 0 V to −400 V was applied. Meanwhile, in a Comparative Example, a low-resistivity film having a volume resistivity of $10^3$ Ω·cm and a uniform thickness of 80 μm was used as the voltage application member, and a DC voltage only was applied. Further, the contact width of the voltage application member against the developing roller 14 (a contact length of the developing roller 14 in its circumferential direction; hereinafter, referred to as "nip width") was set to 4 mm in both Working Example and Comparative Example.

Figure 6:
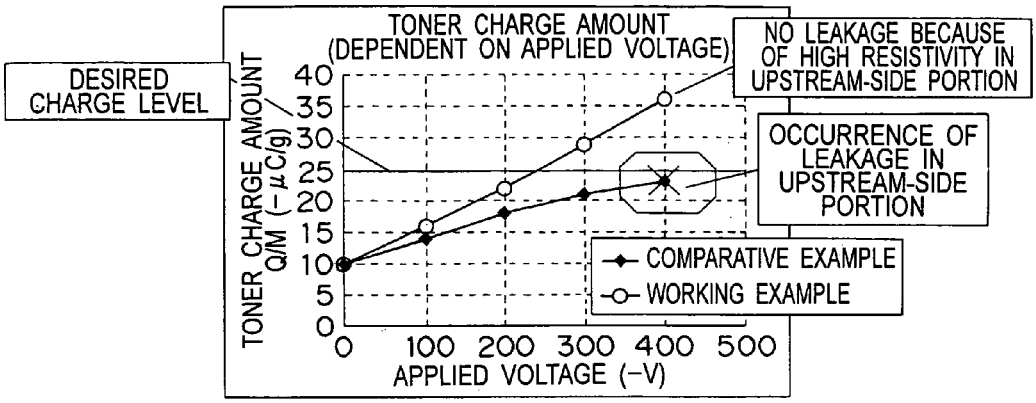
FIG. 6 is a graph showing applied voltage dependence of the toner charge amount.

As shown in the graph of FIG. 6, whereas the toner charge amount tends to gradually increase with increasing applied voltage, the Comparative Example showed an occurrence of leakage at the upstream-side contact portion of the voltage application member at −400 V in the case of the film having a resistivity of $10^3$ Ω·cm, where it was impossible to apply any higher voltages, so that a desired toner charge amount (−25 μc/g) could not be obtained. In contrast to this, the Working Example of the developing device 10, the toner charge amount went beyond a desired value at an applied voltage of −300 V, where no leakage occurred by virtue of a large resistivity of the upstream-side contact portion of the voltage application member even at an applied voltage of −400 V.

Figure 7:
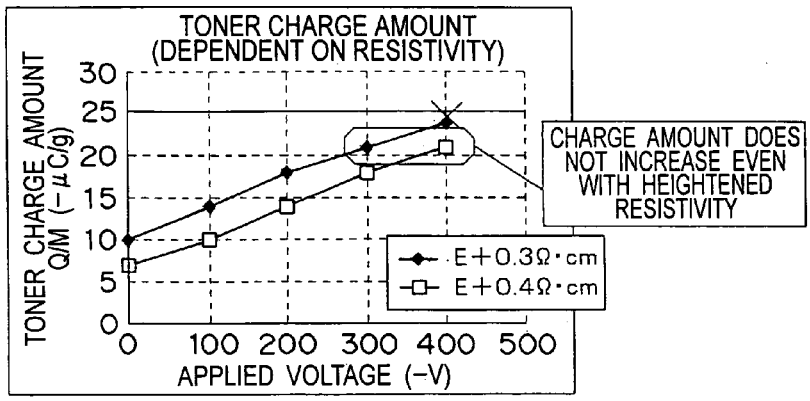
FIG. 7 is a graph showing resistivity dependence of the toner charge amount.

In addition, it would be conceivable, in the Comparative Example, to select a film having a large resistivity to prevent the leakage at the upstream-side contact portion. However, in the case where a film having a resistivity of, for example, $10^4$ Ω·cm is selected as shown in the graph of FIG. 7, indeed the applied voltage can be made higher than that of the film having the resistivity of $10^3$ Ω·cm, but the effective voltage for toner charging becomes so small, causing the charging performance to lower, that the desired toner charge amount can no longer be obtained.

Figure 8:
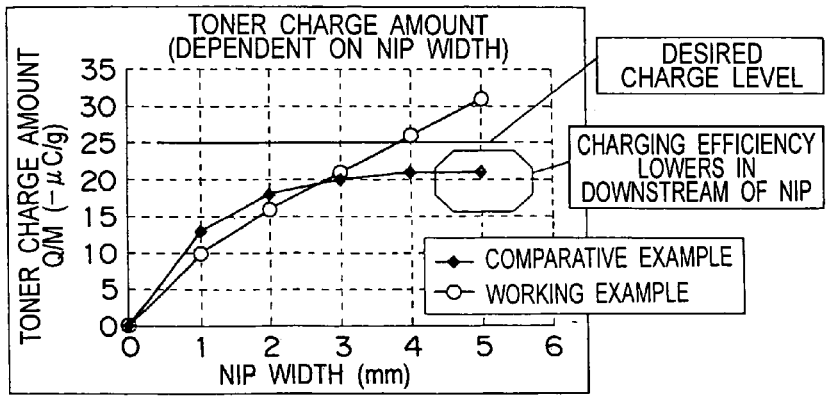
FIG. 8 is a graph showing nip width dependence of the toner charge amount.

On the other hand, it is also conceivable to elongate the nip width to increase the charge injection time for toner so that the toner charge amount is increased. However, in the Comparative Example, as shown in the graph of FIG. 8, even if the nip width was elongated, the toner charge amount reached the ceiling, so that the desired toner charge amount could not be obtained. In contrast to this, in the Working Example of the developing device 10, the toner charge amount exceeded the desired value with the nip width not less than 4 mm, by which very high charging performance was confirmed.

Next, modification examples of the developing device 10 are described with reference to FIGS. 9 to 11.

Figure 9:
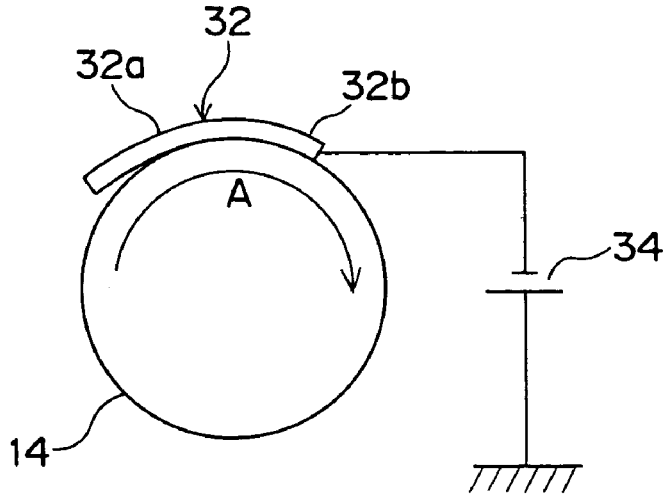
FIG. 9 is a view showing a modification example of the developing device.

As shown in FIG. 9, a voltage application member 32 formed of a semiconductive resin film as an example is composed of one member which is kept in contact with the developing roller 14 over a specified angle range with respect to the rotational direction of the developing roller 14 (a direction of arrow A). To the voltage application member 32, a voltage is to be applied from the downstream-side contact portion 32 side by a power supply 34. The rest of the constitution is similar to that of the foregoing developing device 10.

In the developing device of this modification example, the effective voltage for toner charging in an upstream-side contact portion 32*a* of the voltage application member 32 becomes lower than in a downstream-side contact portion 32*b* by an extent corresponding to a voltage drop due to the resistivity of the voltage application member 32 in a direction along the rotational direction of the developing roller. As a result, with the voltage application member 32, a relatively low voltage is applied to the toner layer on the developing roller 14 in the upstream-side contact portion 32*a* while a relatively high voltage is applied to the toner layer on the developing roller 14 in the downstream-side contact portion 32*b*, so that the same working effects as with the developing device 10 are produced.

In the modification example shown in FIG. 9, it is also possible that the voltage application member 32 is formed of a film having a specified length with respect to the rotational direction of the developing roller 14, and that a downstream-side end portion area of the voltage application member 32 is fixed at an opposing face of the backup member 20 confronting the developing roller 14 in a noncontact state with the developing roller 14 while an upstream-side end portion area of the voltage application member 32 is in surface contact with the outer peripheral surface of the developing roller 14.

Figure 10:
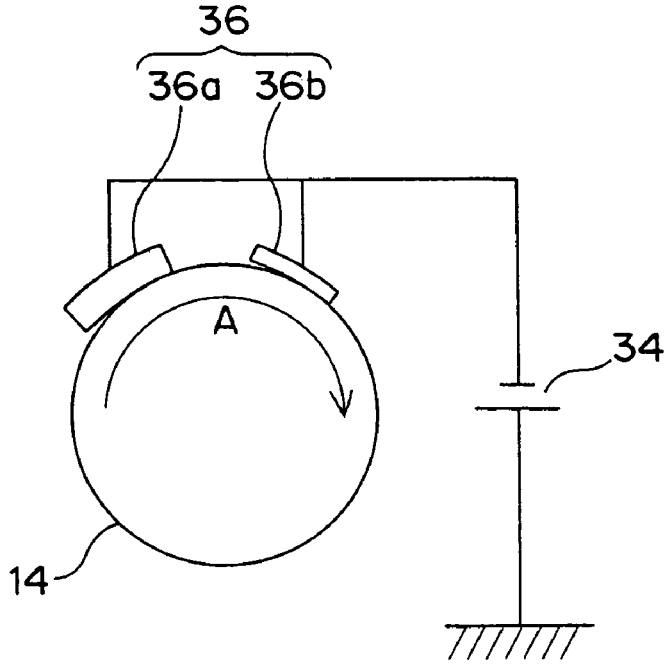
FIG. 10 is a view showing another modification example of the developing device.

Also, in the modification example shown in FIG. 10, a voltage application member 36 is divided into an upstream-side contact portion 36*a* and a downstream-side contact portion 36*b*, to which identical voltages are applied, respectively, by a power supply 34. In this case, the resistivity of the upstream-side contact portion 36*a* is larger than the resistivity of the downstream-side contact portion 36*b*. The rest of the constitution is similar to that of the foregoing developing device 10. As a result, with the voltage application member 36, a relatively low voltage is applied to the toner layer on the developing roller 14 in the upstream-side contact portion 36*a* while a relatively high voltage is applied to the toner layer on the developing roller 14 in the downstream-side contact portion 36*b*, so that the same working effects as with the developing device 10 are produced.

Figure 11:
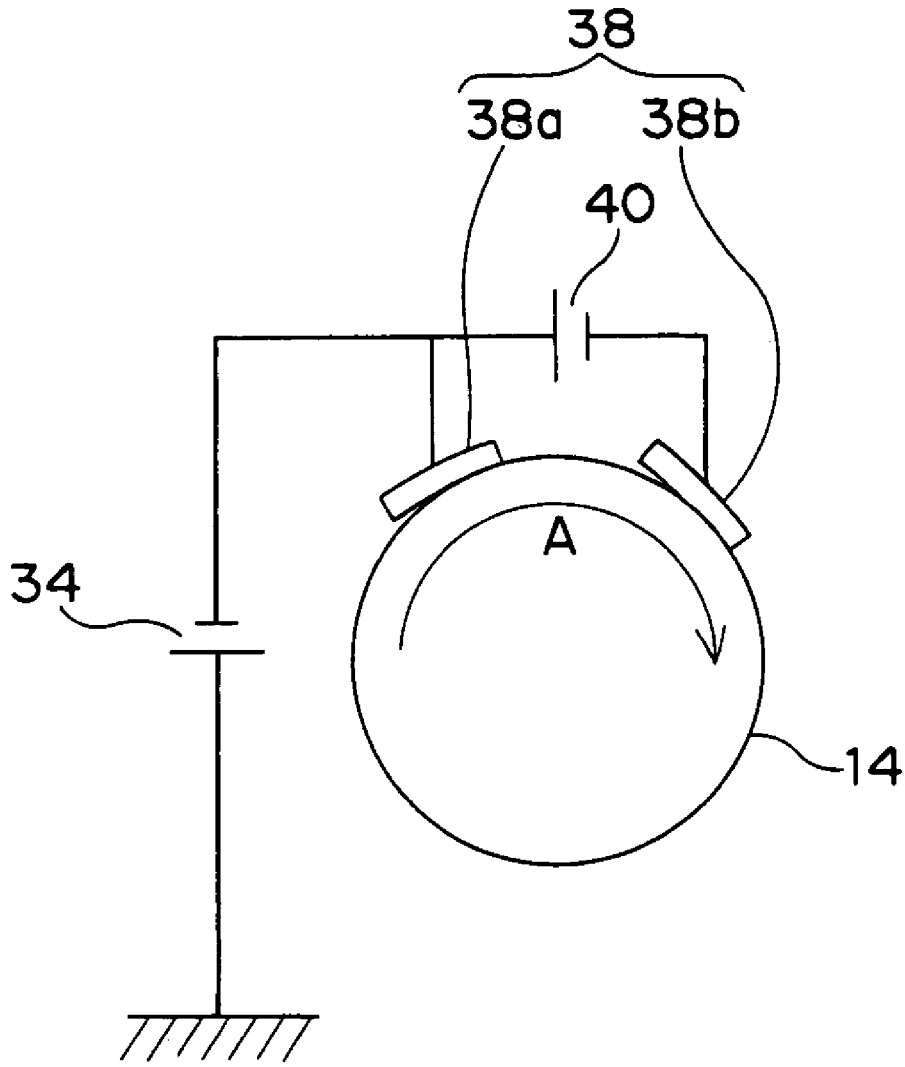
FIG. 11 is a view showing yet another modification example of the developing device.

Further, in the modification example shown in FIG. 11, a voltage application member 38 is divided into an upstream-side contact portion 38*a* and a downstream-side contact portion 38*b*, where the upstream-side contact portion 38*a* and the downstream-side contact portion 38*b* are of the same resistivity. In this case, a relatively low voltage is applied to the upstream-side contact portion 38*a* by the power supply 34 while a relatively high voltage is applied to the downstream-side contact portion 38*b* by power supplies 34, 40. The rest of the constitution is similar to that of the foregoing developing device 10. As a result, the same working effects as with the developing device 10 are produced also in this modification example.

In addition, although the above-described modification examples have been described on a case where the voltage application member is divided into two, the voltage application member may also be divided into three or more.

Although the present invention has been fully described by way of examples with reference to the accompanying drawings, it is to be noted that various changes and modifications will be apparent to those skilled in the art. Therefore, unless otherwise such changes and modifications depart from the scope of the present invention, they should be construed as being included therein.

What is claimed is:

1. A developing device comprising:

a voltage application member configured to maintain contact with a toner layer; and a developing roller configured to concurrently maintain contact with the toner layer and to rotate while holding the toner layer on its outer peripheral surface, wherein the voltage application member is configured to apply a relatively low voltage to the toner layer in an upstream-side contact portion with respect to a rotational direction of the developing roller, wherein the voltage application member is configured to apply a relatively high voltage to the toner layer in a downstream-side contact portion thereof, and wherein the voltage application member comprises one member which makes contact over a specified angle range with respect to the rotational direction of the developing roller, and resistivity of the upstream-side contact portion is larger than resistivity of the downstream-side contact portion.

2. The developing device as claimed in claim 1, wherein the voltage application member is so formed as to be thicker in the upstream-side contact portion and thinner in the downstream-side contact portion.

3. The developing device as claimed in claim 2, wherein thickness of the contact portion of the voltage application member is varied in a step-by-step manner.

4. The developing device as claimed in claim 2, wherein thickness of the contact portion of the voltage application member is continuously varied.

5. The developing device as claimed in claim 1, wherein the upstream-side contact portion and the downstream-side contact portion of the voltage application member are formed of an identical material.

6. The developing device as claimed in claim 1, wherein the upstream-side contact portion and the downstream-side contact portion of the voltage application member are different in material from each other.

7. A developing device comprising:

a voltage application member configured to maintain contact with a toner layer; and a developing roller configured to concurrently maintain contact with the toner layer and to rotate while holding the toner layer on its outer peripheral surface, wherein the voltage application member is configured to apply a relatively low voltage to the toner layer in an upstream-side contact portion with respect to a rotational direction of the developing roller, wherein the voltage application member is configured to apply a relatively high voltage to the toner layer in a downstream-side contact portion thereof, and wherein the voltage application member, by being pressed toward the developing roller by an electrically conductive backup member, is brought into contact with the developing roller over a specified angle range with respect to the rotational direction, and the voltage application member comprises one member to which a voltage is applied via the backup member, and wherein an upstream-side portion of the backup member with respect to the rotational direction of the developing roller is larger in resistivity than a downstream-side portion thereof.

8. A developing device comprising:

a voltage application member configured to maintain contact with a toner layer; and a developing roller configured to concurrently maintain contact with the toner layer and to rotate while holding the toner layer on its outer peripheral surface, wherein the voltage application member is configured to apply a relatively low voltage to the toner layer in an upstream-side contact portion with respect to a rotational direction of the developing roller, wherein the voltage application member is configured to apply a relatively high voltage to the toner layer in a downstream-side contact portion thereof, wherein the voltage application member is divided into the upstream-side contact portion and the downstream-side contact portion, and wherein resistivity of the upstream-side contact portion is larger than resistivity of the downstream-side contact portion, and identical voltages are applied to the upstream-side contact portion and the downstream-side contact portion, respectively.

9. A developing device comprising: a developing roller which, while holding a toner layer on an outer peripheral surface thereof, is placed opposite to a photoconductor on a surface of which a latent image is to be formed; a holding member having an opposing face opposed to the outer peripheral surface of the developing roller; a power supply for applying a voltage to the holding member; and a voltage application member which is fixed to the opposing face of the holding member so as to be in surface contact with the outer peripheral surface of the developing roller, and an upstream-side contact portion of the voltage application member with respect to the rotational direction of the developing roller is higher in resistivity than a downstream-side contact portion thereof.

10. The developing device as claimed in claim 9, wherein thickness of the voltage application member is larger in the upstream-side contact portion than in the downstream-side contact portion.

11. The developing device as claimed in claim 10, wherein thickness of the contact portion of the voltage application member with the developing roller is varied in a step-by-step manner.

12. The developing device as claimed in claim 10, wherein thickness of the contact portion of the voltage application member with the developing roller is continuously varied.

13. The developing device as claimed in claim 9, wherein the upstream-side contact portion and the downstream-side contact portion of the voltage application member are formed of an identical material.

14. The developing device as claimed in claim 9, wherein the upstream-side contact portion and the downstream-side contact portion of the voltage application member are different in material from each other.

* * * * *